US006337612B1

(12) United States Patent
Kim et al.

(10) Patent No.: US 6,337,612 B1
(45) Date of Patent: Jan. 8, 2002

(54) SWITCH USING SOLENOID

(75) Inventors: Duk-Yong Kim; Dong-Hwi Lee, both of Seoul (KR)

(73) Assignee: KMW Co., Ltd., Kwungki-do (KR)

( * ) Notice: Subject to any disclaimer, the term of this patent is extended or adjusted under 35 U.S.C. 154(b) by 0 days.

(21) Appl. No.: 09/551,695

(22) Filed: Apr. 18, 2000

(30) Foreign Application Priority Data

Apr. 19, 1999 (KR) ..... 99-13779

(51) Int. Cl.[7] ..... H01H 53/00

(52) U.S. Cl. ..... 335/4; 335/229; 335/230; 335/234

(58) Field of Search ..... 335/4, 5, 229–234, 335/177, 179

(56) References Cited

U.S. PATENT DOCUMENTS 2,926,318 A * 2/1960 Lanctot ..... 335/5

4,127,835 A * 11/1978 Knutson ..... 335/266

* cited by examiner

*Primary Examiner*—Ramon M. Barrera
(74) *Attorney, Agent, or Firm*—Greenblum & Bernstein, P.L.C.

(57) ABSTRACT

The present invention provides a switch using solenoid comprising a base having a plurality of grooves formed thereon; a plurality of solenoids having an armature respectively, and being disposed on each of the grooves, wherein the armature is moved in upward and downward directions while an electric current flows into the solenoid; a plurality of connectors respectively disposed in the grooves; and a plurality of contact means for electrically connecting the predetermined number of the connectors disposed in each of the grooves, and being movably disposed in each of the grooves to be pressed by the armature moved in downward direction. Therefore, the number of parts and manufacturing cost of the switch in accordance with the present invention are reduced, and total size of the switch may be minimized.

14 Claims, 8 Drawing Sheets

SWITCH USING SOLENOID

FIELD OF THE INVENTION

The present invention relates to a switch using solenoid utilized in a radio frequency system. More particularly, it relates to a switch using solenoid capable of reducing the number of parts and total size of the switch.

DESCRIPTION OF THE PRIOR ART

Generally, there are a latching type switch, a fail-safe type switch and the like in switches using solenoid for a radio frequency system.

Hereinafter, conventional switches using solenoid will be schematically described, referring to FIGS. 1 and 2.

FIG. 1 shows a structure of the latching type switch using solenoid of the prior art.

As shown in FIG. 1, the conventional latching type switch has two solenoids 1 and 2 generating a magnetic field when electric current flows thereinto, a permanent magnet 3 located between the two solenoids 1 and 2, and a rocker 4 disposed under the solenoids 1 and 2. The rocker 4 is magnetized by the permanent magnet 3 to have N-S-N poles. Therefore, when electric current flows into the solenoid 1 or 2, the magnetized rocker 4 seesaws with center in the middle portion thereof and performs switching operation. That is, when electric current flows into the right solenoid 2 so that N pole (North Pole) is generated in the lower portion thereof, repulsion occurs between the right solenoid 2 and the right portion of the rocker 4 adjacent to the right solenoid 2. In this case, the right portion of the rocker 4 is descended and the left portion of the rocker 4 is ascended, so that the left portion of the rocker 4 is contacted to the bottom surface of the left solenoid 1.

On the contrary, when electric current flows into the left solenoid 1, the left portion of the rocker 4 is descended and the right portion of the rocker 4 is ascended, thereby contacting the right portion to the lower surface of the right solenoid 2.

Further, the conventional latching type switch has a plate spring 5 fixed to the lower portion of the rocker 4, two push pins 6 and 7 respectively located under both sides of the plate spring 5, and a plurality of connectors 8*a*, 8*b* and 8*c* located under the push pins 6 and 7. The push pins 6 and 7 have compression coil springs 6*a* and 7*a* respectively surrounding the upper portion thereof, and reeds 6*b* and 7*b* fixed to lower end thereof.

The plate spring 5 is moved in upward and downward directions together with the rocker 4. Therefore, when electric current flows into the right solenoid 2, the right portion of the plate spring 5 is descended by seesaw of the rocker 4 and presses the push pin 7. Simultaneously, the reed 7*b* fixed to lower end of the push pin 7 electrically connects the connectors 8*b* and 8*c*. In this state, when electric current flowing into the solenoid 2 is turned off and electric current flows into the left solenoid 1, the push pin 6 is pressed by seesaw of the rocker 4. Then, the compression coil spring 7*a* provides a restoring force for the push pin 7, thereby ascending the moved push pin 7 and separating the reed 7*b* from the connectors 8*b* and 8*c*. Further, the reed 6*b* fixed to the lower end of the push pin 6 electrically connects the connectors 8*a* and 8*b*.

However, since the conventional latching type switch using solenoid requires two solenoids to move a rocker, the total size of the switch is large and the manufacturing cost is expensive.

Meanwhile, FIG. 2 shows a structure of the fail-safe type switch using solenoid of the prior art.

As shown in FIG. 2, the conventional fail-safe type switch comprises a solenoid 10 generating a magnetic field while electric current flows thereinto, a pushing rod 20 movably disposed at center portion of the solenoid 10, a rocker 30 located under the pushing rod 20, a compression spring 40 disposed on the rocker 30, and a plurality of connectors 61, 62 and 63. Further, under both sides of the rocker 30, two push pins 51 and 52 are movably disposed in upward and downward directions. Also, the push pins 51 and 52 have compression coil springs 51*a* and 52*a* respectively surrounding their peripheral surfaces, and reeds 51*b* and 52*b* fixed to their lower ends.

In this case, the pushing rod 20 is adjacent to the left portion of the rocker 30 and a lower end of the compression spring 40 is fixed to the right portion of the rocker 30.

In the state, when electric current flows into the solenoid 10 to generate the magnetic field, the pushing rod 20 descends and presses the left portion of the rocker 30. Then, the rocker 30 seesaws with center in the middle portion thereof, thereby pushing down the left push pin 51 so that the reed 51*b* fixed to the lower end of the push pin 51 electrically connects the connectors 61 and 62 and the compression spring 40 is compressed. The inclined state of the rocker 30 is continuously retained while electric current flows into the solenoid 10.

On the contrary, when electric current flowing into the solenoid 10 is turned off, the right portion of the rocker 30 is descended by restoring force of the compression spring 40 and the left portion of the rocker 30 is ascended. In this case, the right push pin 52 pressed by the right portion of the rocker 30 is descended so that the reed 52*b* electrically connects the connectors 62 and 63. Simultaneously, the left push pin 51 is ascended by restoring force of the compression coil spring 51*a* surrounding its peripheral portion.

However, since the conventional fail-safe type switch, for retaining the state descending the left push pin, must continuously flow electric current into the solenoid, the solenoid radiates high-temperature heat disturbing flow of electric current, thereby weakening the force moving the pushing rod. Therefore, since the size of the solenoid must be large in order to compensate the weakened force, total size of the fail-safe type switch is larger than the conventional latching type switch.

SUMMARY OF THE INVENTION

It is, therefore, an object of the present invention to provide a switch using solenoid capable of reducing the number of parts and a manufacturing cost of the switch, and minimizing total size of the switch.

In accordance with an aspect of the present invention, the switch of the present invention comprises a base having a plurality of grooves formed thereon; a plurality of solenoids having an armature respectively, and being respectively disposed above the grooves, wherein the armature is moved in upward and downward directions while an electric current flows into the solenoid; a plurality of connectors respectively disposed in the grooves; and a plurality of contact means for electrically connecting the connectors disposed in each of the grooves, and being movably disposed in the grooves to be pressed by the armature moved in downward direction.

Also, in another aspect of the present invention, solenoid used in the switch comprises a bobbin core generating a magnetic field while an electric current flows thereinto, and having a through hole formed vertically therethrough; a conductive coil for guiding the electric current, and being wound round peripheral surface of the bobbin core; an armature being magnetized by the magnetic field generated on the bobbin core, and being movably disposed within the through hole; a plurality of magnetization means generating a definite magnetic field, and being disposed at both ends of the bobbin core; a plurality of first magnetic substances disposed between the bobbin core and each of the magnetization means, and being magnetized by the magnetization means adjacent thereto; and a plurality of second magnetic substances respectively disposed at outer sides of the magnetization means, and being magnetized by the magnetization means adjacent thereto.

BRIEF DESCRIPTION OF THE DRAWINGS

The above and other objects and features of the present invention will become apparent from the following description of the preferred embodiment given in connection with the accompanying drawings, in which.

DETAILED DESCRIPTION OF THE PREFERRED EMBODIMENTS

Hereinafter, an embodiment of the switch using solenoid according to the present invention will be described in detail, referring to the accompanying drawings.

Figure 1:
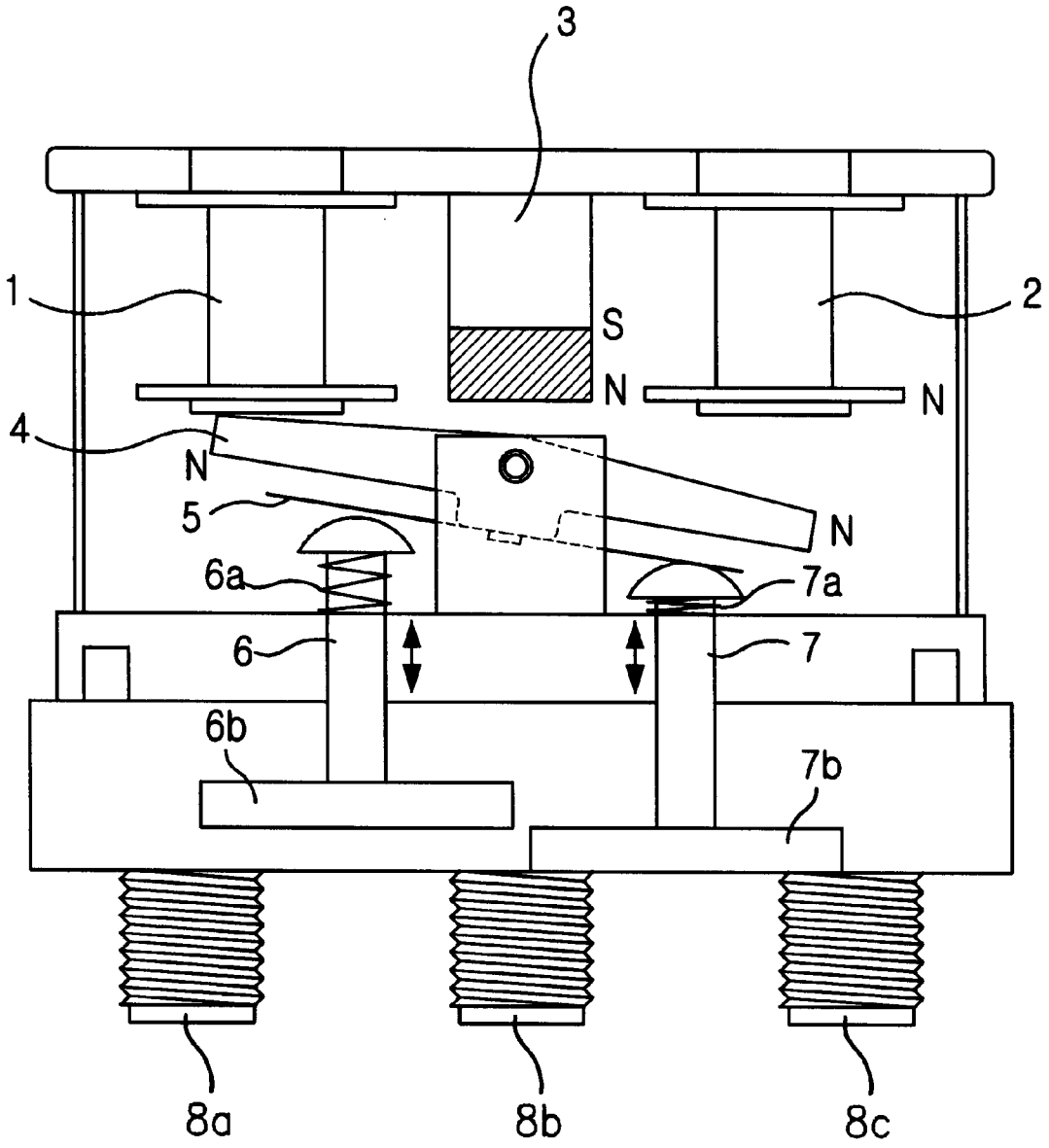
FIG. 1 (PRIOR ART)
FIG. 1 is a cross-sectional view schematically illustrating a latching type switch using solenoid of a prior art.
Figure 2:
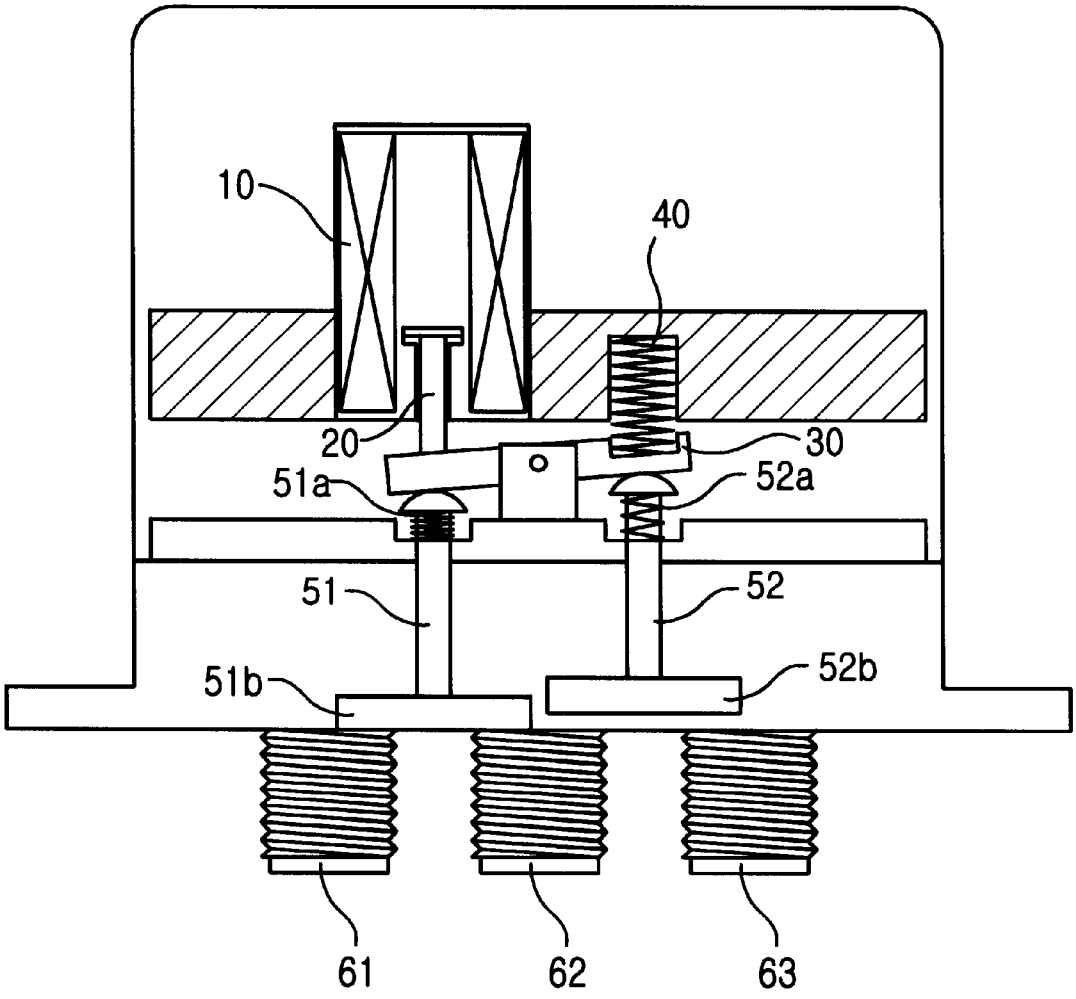
FIG. 2 (PRIOR ART)
FIG. 2 is a cross-sectional view schematically showing a fail-safe type switch using solenoid of the other prior art.
Figure 3:
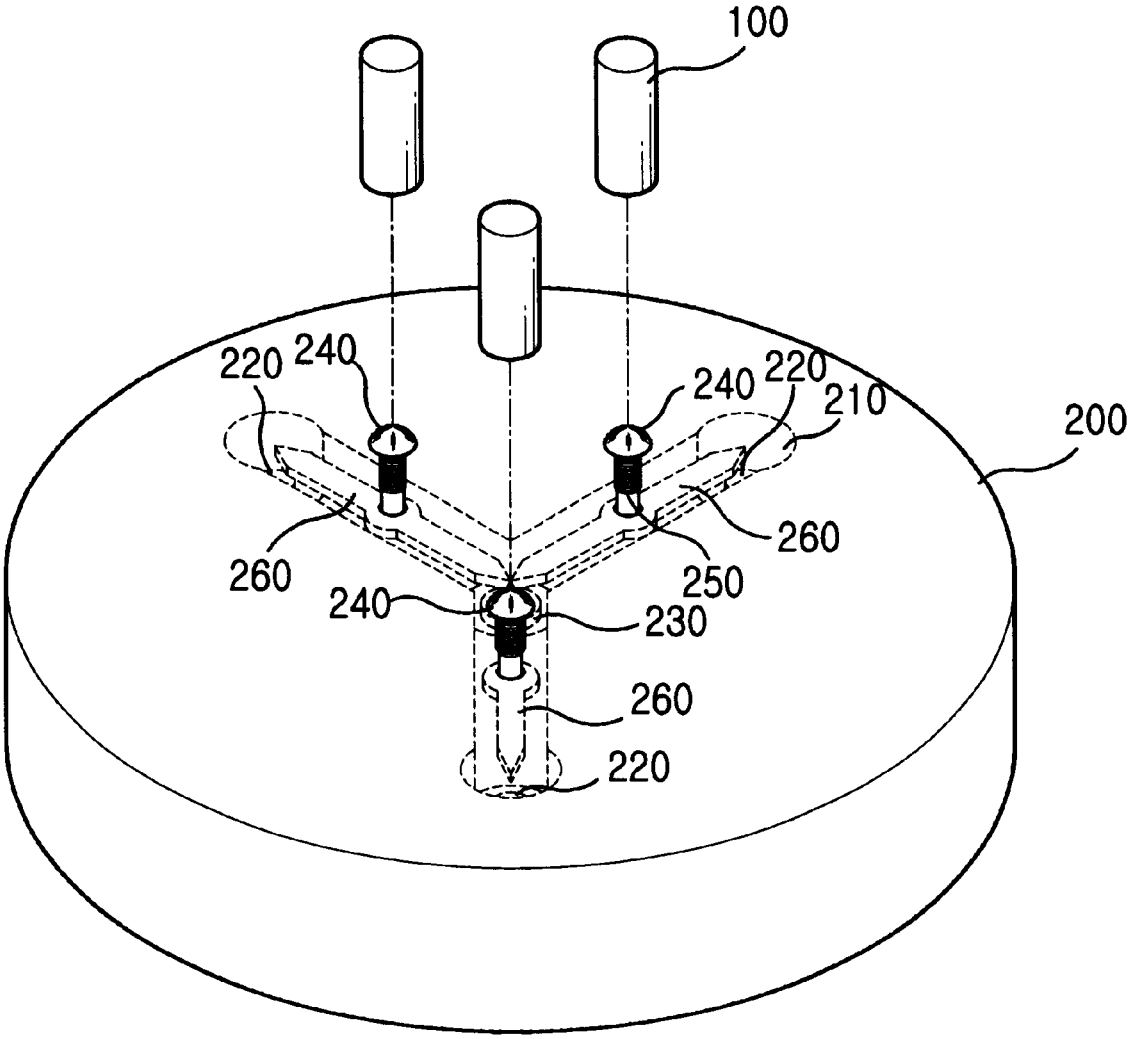
FIG. 3 is an assembled perspective view schematically illustrating a switch using solenoid according to the present invention.

As shown in FIG. 3, the switch using solenoid of the present invention comprises a plurality of solenoids 100 generating magnetic field while electric current flows thereinto.

Figure 4A:
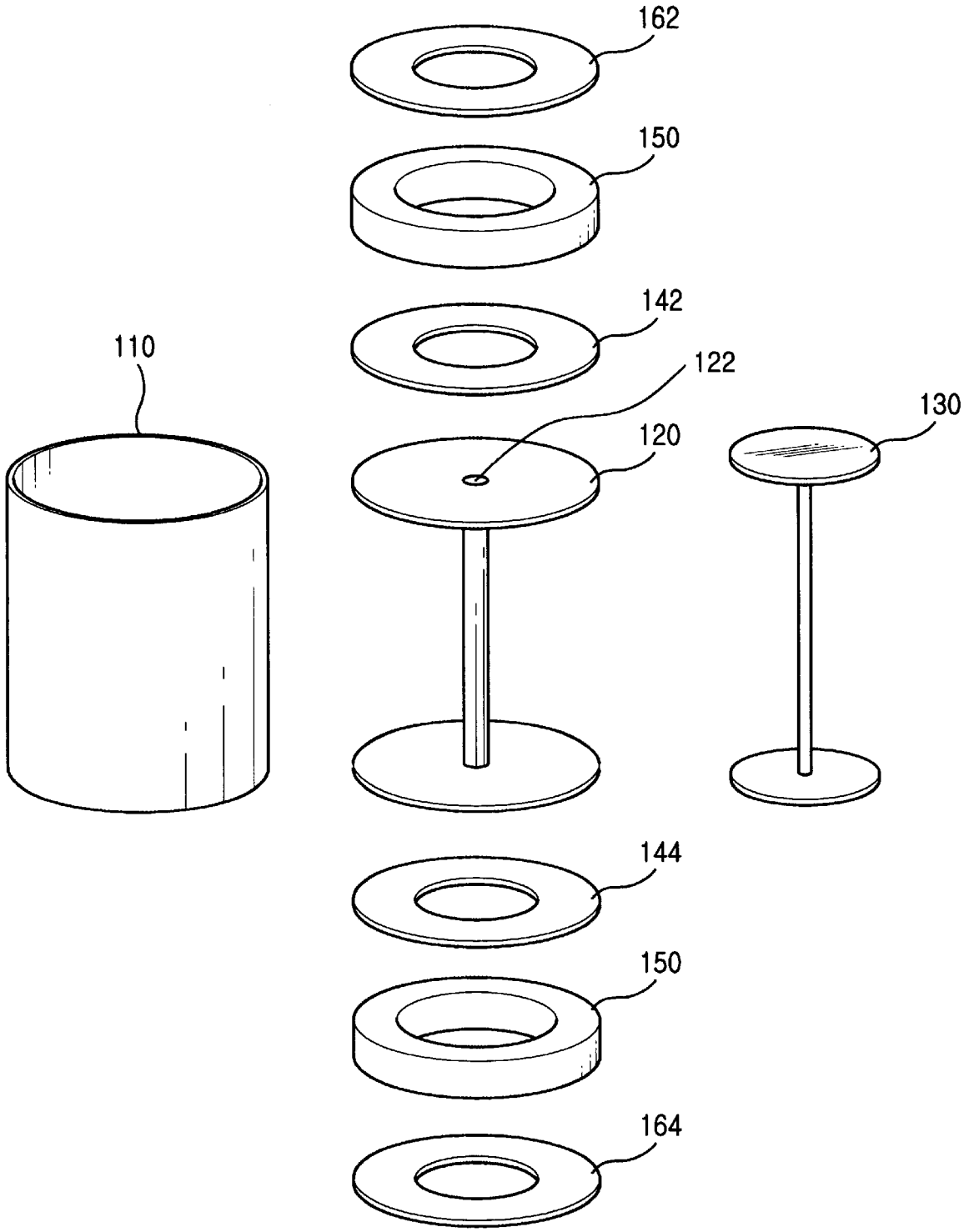
FIG. 4A is a disassembled perspective view showing a solenoid of the FIG. 3.
Figure 4B:
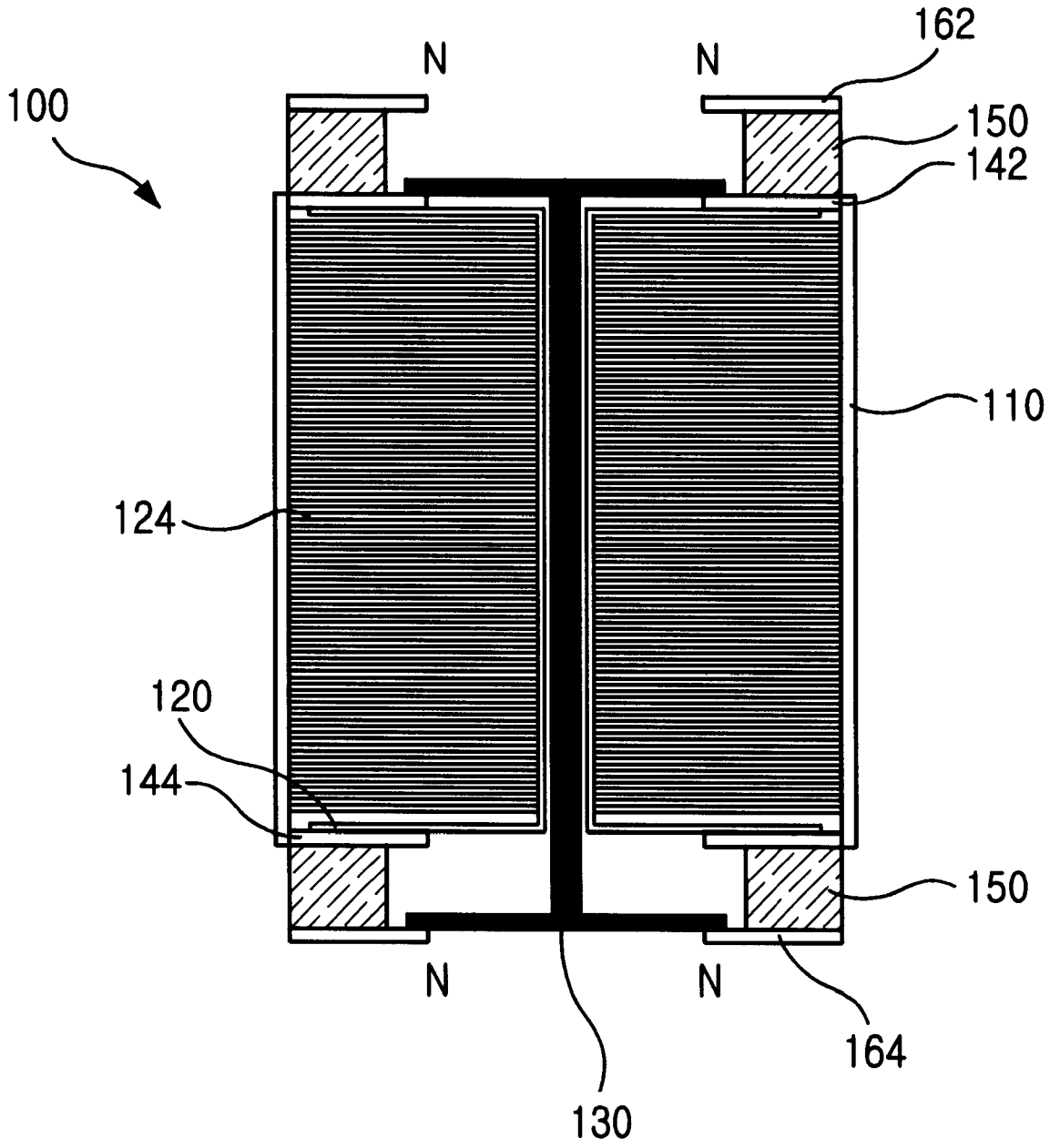
FIG. 4B is a cross-sectional view representing the solenoid of the FIG. 3.

Each of the solenoids 100, as shown in FIGS. 4A and 4B, has a hollow cylindrical housing 110, and an I-shaped bobbin core 120 disposed within the housing 110. The bobbin core 120 has a through hole 122 longitudinally formed in center thereof, and a conductive coil 124 wound round the peripheral surface thereof. Further, each of the solenoid 100 has an I-shaped armature 130 movably disposed within the through hole 122 of the bobbin core 120. Preferably, the armature 130 is made of magnetic substance. In this case, when electric current flows into the solenoid 100 through the coil 124, the armature 130 is magnetized and generates predetermined poles.

Furthermore, each of the solenoids 100 has a plurality of first ring-shaped magnetic substances 142 and 144 respectively disposed at upper and lower portions between the bobbin core 120 and the armature 130, a plurality of ring-shaped permanent magnets 150 respectively disposed at outer surface of each of the first magnetic substances 142 and 144, and a plurality of second ring-shaped magnetic substances 162 and 164 respectively disposed at outer surface of each of the permanent magnets 150. Each of the first and second magnetic substances 142, 144, 162, and 164 is magnetized by one of the permanent magnets 150 adjacent thereto and has a predetermined pole.

Further, the switch of the embodiment has a base 200 located under the solenoids 100. The base 200 has a plurality of grooves 210 formed thereon. In this case, an end of each of the grooves 210 is a common portion to meet at center portion of the base 200 and the upper portions of the grooves 210 are closed. The number of the grooves 210 is equal to the number of the solenoids 100.

Further, the switch using solenoid of the embodiment has a plurality of independent connectors 220 respectively disposed at the other end of each of the grooves 210, a common connector 230 disposed at the common portion, and a plurality of push pins 240 movably disposed at upper portion of each of the grooves 210. Each of the push pins 240 has the upper portion protruded from the base 200 and the lower portion located within the groove 210. In this case, the upper portion of the push pin 240 is surrounded by a compression coil spring 250 and the lower end of the push pin 240 is fixed to a contact reed 260. When the push pin 240 is pressed by the armature 130, the contact reed 260 is downwardly moved together with the push pin 240. Then, the contact reed 260 electrically connects the independent connector 220 to the common connector 230. The coil spring 250 provides a restoring force that the push pin 240 pressed by the armature 130 returns to its original position.

Next, in conjunction to the present invention constructed above, the following describes how the switch using solenoid is operated.

In the embodiment, when the magnetic substances 142, 144, 162, and 164 are magnetized by the permanent magnets 150, the first magnetic substances 142 and 144 have S-pole (South pole) and the second magnetic substances 162 and 164 have N-pole (North pole).

Figure 5A:
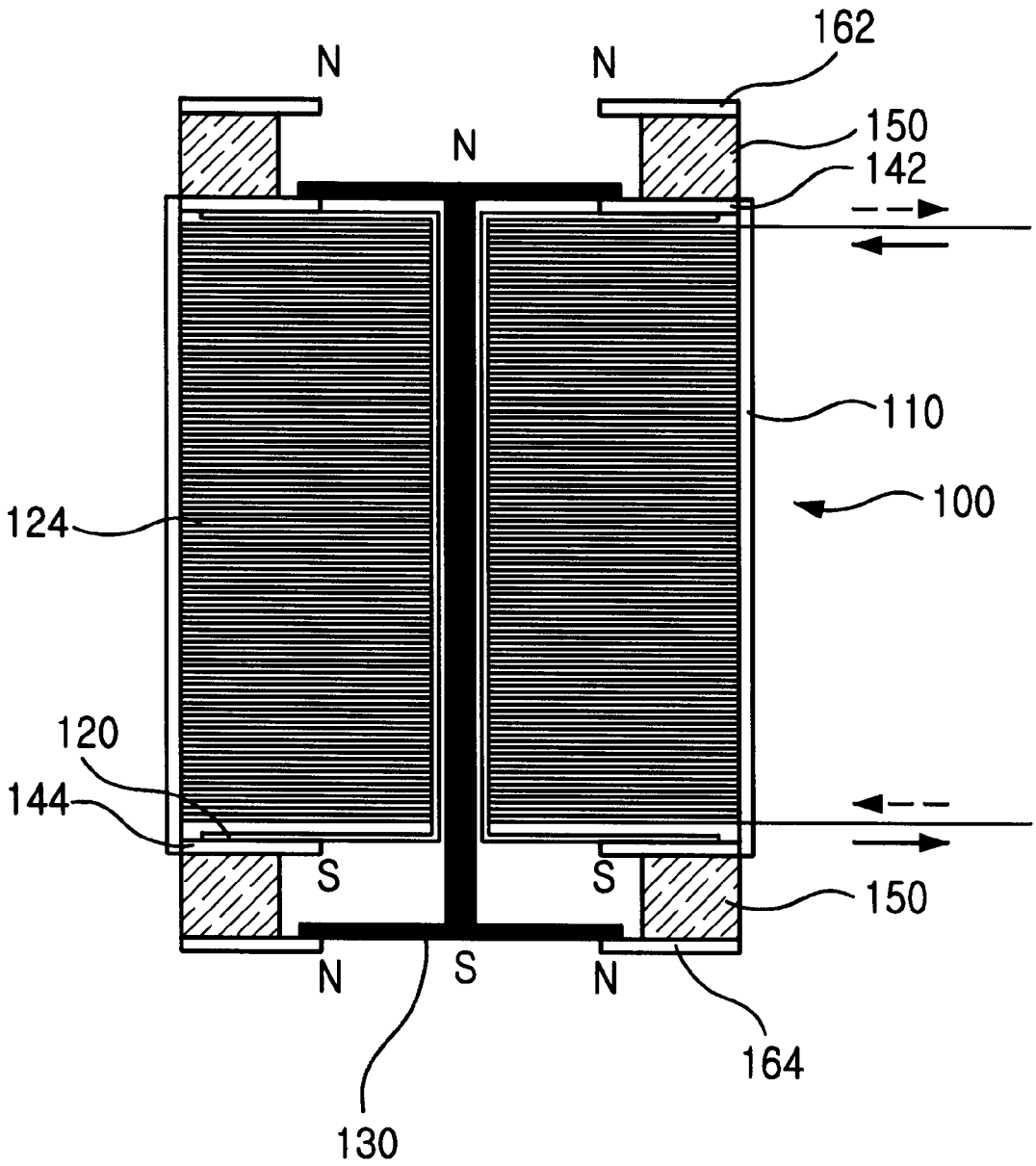
FIGS. 5A and 5B are cross-sectional view depicting operation of the solenoid of FIG. 4B, respectively.
Figure 6:
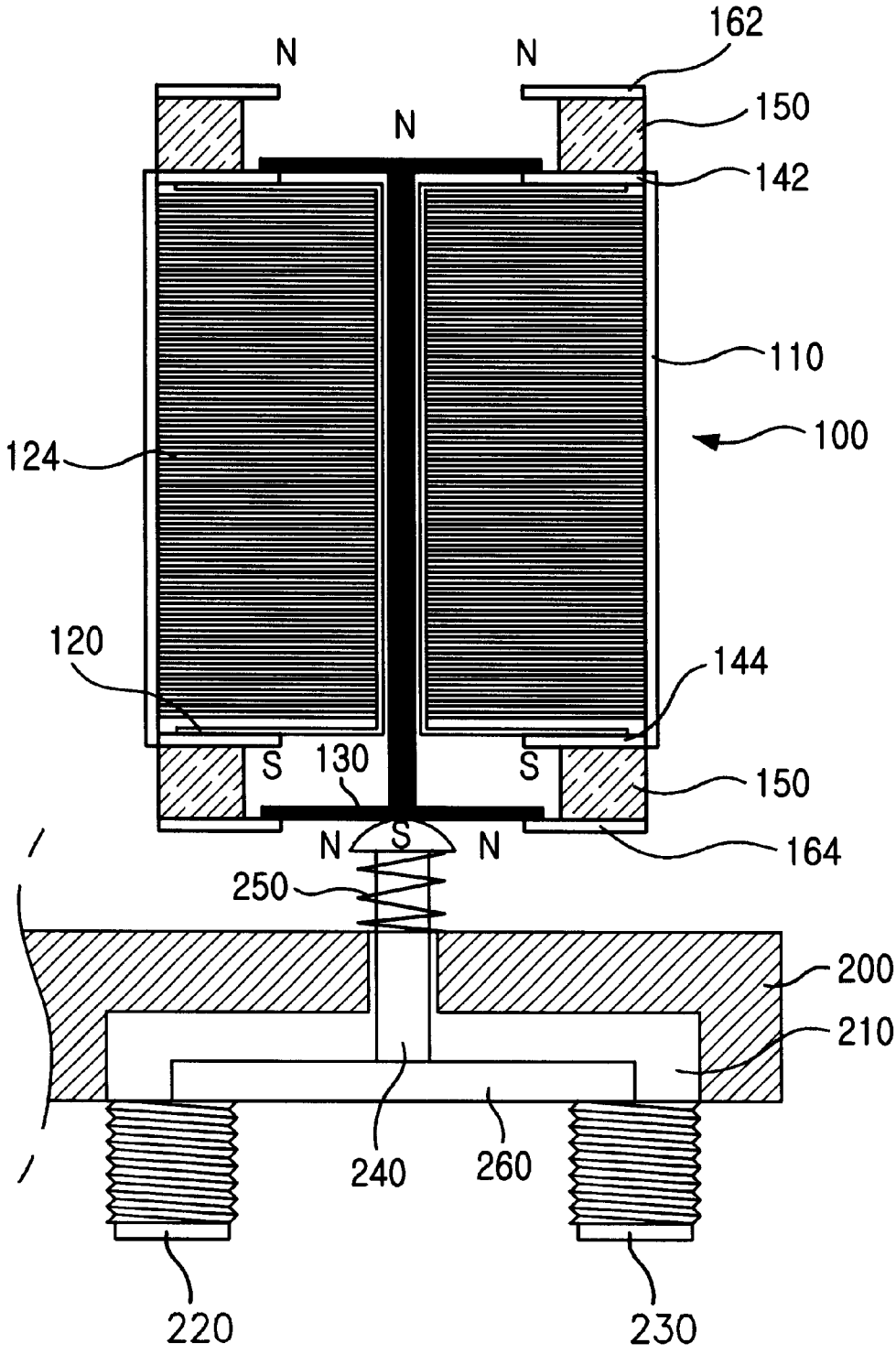
FIG. 6 is a cross-sectional view schematically illustrating operation of the switch using solenoid according to the present invention.

In this state, as shown in FIGS. 5A and 6, if the forward electric current(designated by a solid line arrow) flows into the solenoid 100 through the coil 124, the upper portion of the armature 130 has N-pole and the lower portion of the armature 130 has S-pole.

In this case, attraction occurs between the upper portion of the armature 130 and the upper first magnetic substance 142 and repulsion occurs between the lower portion of the armature 130 and the lower first magnetic substance 144. Simultaneously, repulsion occurs between the upper portion of the armature 130 and the upper second magnetic substance 162, and attraction occurs between the lower portion of the armature 130 and the lower second magnetic substance 164. Therefore, the armature 130 is descended and contacted to the upper first magnetic substance 142 and the lower second magnetic substance 164. In this case, the descended armature 130 presses the push pin 240 so that the contact reed 260 fixed to the push pin 240 is downwardly moved and electrically connects the independent connector 220 to the common connector 230.

Then, even if electric current flowing into the armature 130 is turned off, the armature 130 can continuously retain the state contacted to the magnetic substances 142 and 164 by the magnetic force of the permanent magnet 150.

Figure 5B:
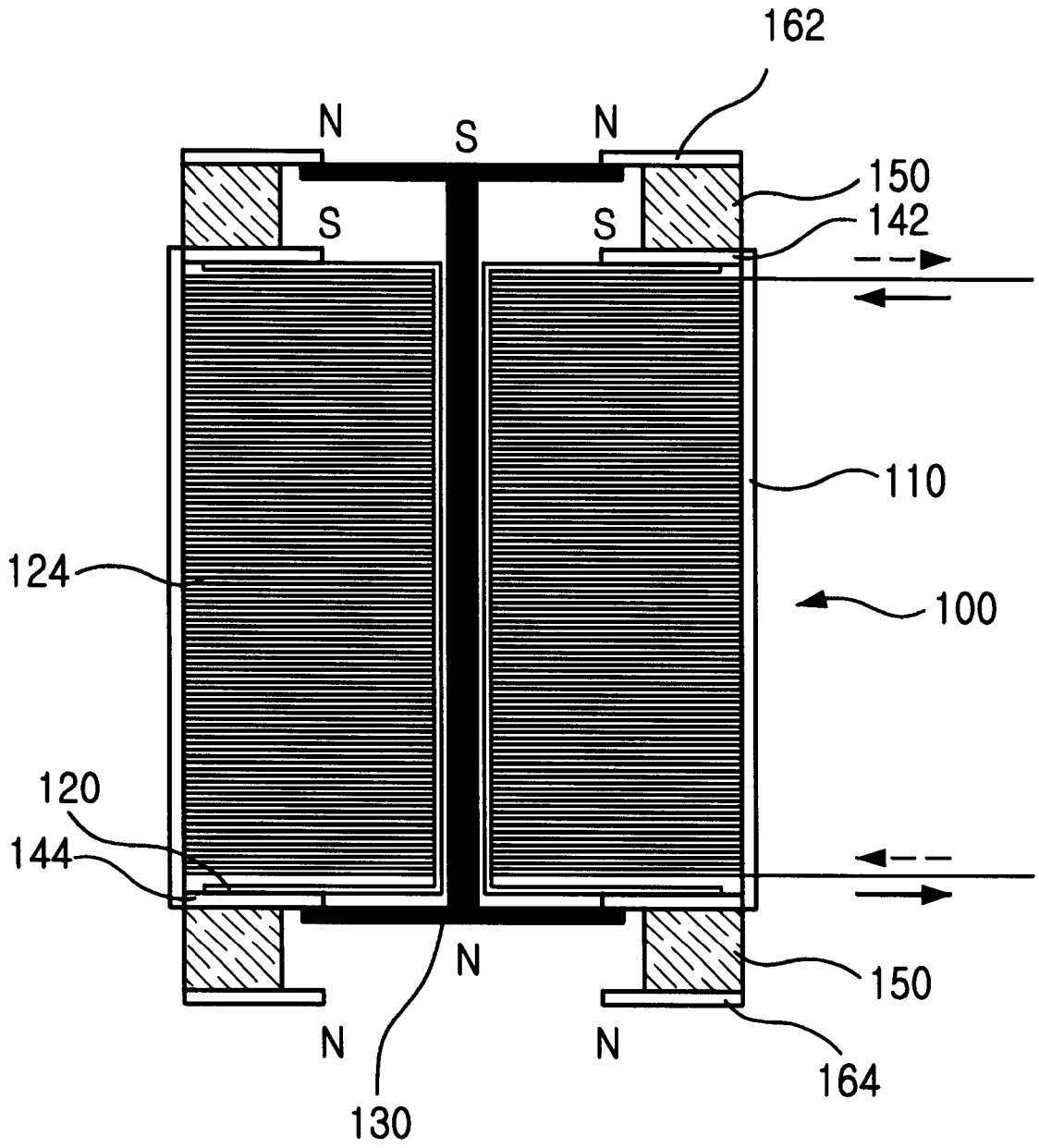

On the contrary, as shown in FIG. 5B, if the reverse electric current(designated by a dotted line arrow) flows into solenoid 100 through the coil 124, the upper portion of the armature 130 has S-pole and the lower portion of the armature 130 has N-pole.

In this case, repulsion occurs between the upper portion of the armature 130 and the upper first magnetic substance 142, and attraction occurs between the lower portion of the armature 130 and the lower first magnetic substance 144. Simultaneously, attraction occurs between the upper portion of the armature 130 and the upper second magnetic substance 162, and repulsion occurs between the lower portion of the armature 130 and the lower second magnetic substance 164. Therefore, the armature 130 is ascended, thereby being contacted to the upper second magnetic substance 162 and the lower first magnetic substance 144. In this case, the push pin 240 pressed by the armature 130 and the contact reed 260 fixed to the push pin 240 are upwardly moved by elastic force of the coil spring 250 surrounding peripheral surface thereof. Even if the reverse electric current flowing into the armature 130 is turned off, the armature 130 can continuously retain the state contacted to the magnetic substances 144 and 162 by the magnetic force of the permanent magnet 150.

At the both case, a movement of the armature 130 is completed within about 0.01 second(i.e., 10 milliseconds) and a flow time of electric current required for moving the armature 130 is about 0.03 seconds(i.e., 30 milliseconds). Therefore, the solenoid 100 does not radiate high-temperature heat disturbing flow of electric current.

Since the switch according to the present invention constructed and operated as above-mentioned does not require a rocker used in the prior art, it is possible to reduce the number of parts. Therefore, the manufacturing cost and total size of the switch can be minimized.

Further, since it is unnecessary to flow electric current into the solenoid continuously, the electric power consumption can be decreased.

While the present invention has been described with respect to certain preferred embodiments only, other modifications and variation may be made without departing from the spirit and scope of the present invention as set forth in the following claims.

What is claimed is:

1. A solenoid, comprising:

a bobbin, defining a guide hole and comprising a pedestal, a first end part and a second end part, said first end part and said second end part being positioned on opposite ends of said pedestal, and said guide hole passing through said pedestal, said first end part and said second end part;

a conductive coil wound around said pedestal of said bobbin, said conductive coil conducting an electric current;

an armature, comprising a rod, a first member and a second member, said rod extending through said guide hole, and said first member and said second member being positioned on opposite ends of said rod;

a plurality of permanent magnets axially mounted on opposite ends of said conductive coil;

a plurality of first magnetic substances, each of said plurality of first magnetic substances being positioned between one of said plurality of permanent magnets and one of said first end part and said second end part of said bobbin; and a plurality of second magnetic substances, each of said plurality of second magnetic substances being disposed at an outer side of one of said plurality of permanent magnets;

wherein said first member and said second member of said armature move freely between one of said plurality of first magnetic substances and one of the said plurality of second magnetic substances.

2. The solenoid of claim 1, each of said plurality of permanent magnets comprising an annular disk.

3. The solenoid of claim 1, said armature comprising a magnetic substance.

4. A switch using solenoids, the switch comprising:

a base, defining a plurality of grooves;

a plurality of solenoids, each of said plurality of solenoids being disposed in a respective one of said plurality of grooves and comprising:

a bobbin core that generates a magnetic field when an electric current flows into said solenoid, said bobbin core defining a vertical through-hole;

an armature, extending through the vertical through-hole, that moves in an upward direction and a downward direction when the electric current flows into said solenoid;

a conductive coil that conducts the electric current, said conductive coil being wound around an outer peripheral surface of said bobbin core;

a plurality of magnets that generate a magnetic field, said plurality of magnets being disposed at opposing ends of said bobbin core;

a plurality of first magnetic substances that are magnetized by at least one of said plurality of magnets, each of said plurality of first magnetic substances being disposed between one of the opposing ends of said bobbin core and the at least one of said plurality of magnets; and a plurality of second magnetic substances that are magnetized by at least one of said plurality of magnets, each of said plurality of second magnetic substances being disposed at an outer side of the at least one of said plurality of magnets;

a plurality of connectors, each of said plurality of connectors being disposed in a respective one of said plurality of grooves; and a plurality of contacts, each of said plurality of contacts being movably disposed in a respective one of said plurality of grooves and comprising:

a push pin that is pressed by said armature moving in the downward direction;

a reed, connected to said push pin, that electrically connects a respective one of said plurality of connectors to a common connector; and a spring that provides a restoring force to return said pressed push pin to an original position when said armature moves in the upward direction.

5. The switch of claim 4, each of said plurality of magnets comprising a permanent magnet.

6. The switch of claim 4, said armature comprising a magnetic substance.

7. A switch using solenoids, said switch comprising:

a base, comprising a plurality of N connectors, wherein N is a positive integer;

a plurality of N solenoids, each of said solenoids comprising an armature, said armature comprising a push rod; and a plurality of N contact members, each of said contact members being positioned above a corresponding one of said plurality of connectors and being connected to the push rod of a corresponding one of said plurality of solenoids;

wherein, when said armature of one of said plurality of solenoids is magnetized in a first direction, said corresponding push rod moves said corresponding contact member into electrical contact with said corresponding connector; and wherein, when said armature is magnetized in a second direction, opposite to the first direction, said corresponding push rod moves said corresponding contact member out of electrical contact with said corresponding connector.

8. The switch of claim 7, said base defining a plurality of N holes.

9. The switch of claim 8, further comprising:

a plurality of N push pins, each of said push pins being disposed in one of said plurality of N holes through said base and connecting to a corresponding one of said plurality of contact members, each of said push pins being actuated by a corresponding push rod of one of said plurality of solenoids.

10. The switch of claim 7, further comprising a common connector, wherein, when said push rod moves said corresponding contact member into electrical contact, the corresponding one of said plurality of connectors is connected with said common connector.

11. The switch of claim 10, each of said plurality of connectors being positioned on said base at an equal distance from said common connector.

12. The switch of claim 7, said base further comprising a plurality of N grooves, said plurality of grooves being positioned on a top surface of said base and said plurality of connectors being positioned on a bottom surface of said base.

13. The switch of claim 12, each of said plurality of contact members being movably positioned in a corresponding one of said plurality of grooves.

14. A switch, comprising:

a base, defining a plurality of grooves that intersect at a common groove area, each of said plurality of intersecting grooves having an end spaced from the common area;

a common connector positioned in the common groove area;

a plurality of independent connectors, each independent connector being positioned at the end of a corresponding one of said plurality of intersecting grooves;

a plurality of solenoids, each solenoid comprising an axially moveable armature that drives a push rod; and a plurality of movable contacts corresponding to said plurality of independent connectors, each movable contact being connected to the push rod of a corresponding one of said plurality of solenoids;

wherein, when the armature of one of said plurality of solenoids is magnetized in a first direction, the push rod moves the corresponding moveable contact to electrically connect said common connector and the corresponding independent connector of said plurality of independent connectors, the corresponding moveable contact remaining electrically connected to said common connector when the armature is no longer magnetized; and wherein, when the armature of one of said plurality of solenoids is magnetized in a second direction opposite to the first direction, the push rod moves the corresponding moveable contact to electrically disconnect said common connector and the corresponding independent connector of said plurality of independent connectors, the corresponding moveable contact remaining electrically disconnected from said common connector when armature is no longer magnetized.

* * * * *

UNITED STATES PATENT AND TRADEMARK OFFICE

CERTIFICATE OF CORRECTION

PATENT NO. : 6,337,612 B1
DATED : January 8, 2002
INVENTOR(S) : D.Y. Kim et al.

It is certified that error appears in the above-identified patent and that said Letters Patent is hereby corrected as shown below:

Title page,
Item [73], Assignee, "Kwungki-do" should be -- Kyungki-do --.

Signed and Sealed this

Twelfth Day of November, 2002

*Attest:*

*Attesting Officer*

JAMES E. ROGAN
*Director of the United States Patent and Trademark Office*